US009894714B2

(12) United States Patent
Sakui et al.

(10) Patent No.: US 9,894,714 B2
(45) Date of Patent: Feb. 13, 2018

(54) ELECTRICAL HEATING DEVICE AND ELECTRICAL HEATING METHOD

(71) Applicant: TOYOTA JIDOSHA KABUSHIKI KAISHA, Toyota-shi (JP)

(72) Inventors: Takashi Sakui, Nagoya (JP); Hirokazu Morishita, Toyota (JP); Asahiko Hasebe, Miyoshi (JP); Maho Kimura, Toyota (JP); Yusuke Matsumoto, Okazaki (JP); Kenichi Morita, Toyota (JP); Hisanori Nakamura, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/176,974

(22) Filed: Jun. 8, 2016

(65) Prior Publication Data

US 2017/0019950 A1 Jan. 19, 2017

(30) Foreign Application Priority Data

Jul. 17, 2015 (JP) ..... 2015-143088

(51) Int. Cl.

*H05B 1/02* (2006.01)
*H05B 3/03* (2006.01)
*H05B 3/42* (2006.01)

(52) U.S. Cl.

CPC ..... *H05B 1/0202* (2013.01); *H05B 3/03* (2013.01); *H05B 3/42* (2013.01)

(58) Field of Classification Search

CPC ..... H05B 1/0202; H05B 3/03; H05B 3/42; H05B 2203/005; H05B 3/023

USPC ..... 219/494, 476, 483, 486

See application file for complete search history.

(56) References Cited

U.S. PATENT DOCUMENTS 4,672,627 A * 6/1987 Dunn ..... C03B 5/027 373/38
5,234,516 A * 8/1993 Okamura ..... B32B 15/08 156/244.17
5,585,177 A * 12/1996 Okamura ..... B32B 15/08 220/62.22

(Continued)

FOREIGN PATENT DOCUMENTS

DE 197 20 652 A1 11/1997
JP 10-317065 12/1998
JP 2014-31566 2/2014

*Primary Examiner* — Mark Paschall
(74) *Attorney, Agent, or Firm* — Oblon, McClelland, Maier & Neustadt, L.L.P.

(57) ABSTRACT

An electrical heating device electrically heats a material to be heated by supplying an electric current flowing between a plurality of electrodes. The electrical heating device includes a temperature detection device which detects temperature information of a plurality of areas of the material to be heated, a supplemental heating device which heats each of the plurality of areas of the material to be heated, and a controller for controlling heating of the material to be heated. During the electrical heating, the controller controls, based on the temperature of each of the plurality of areas of the material to be heated detected by the temperature detection device, the supplemental heating device so that the supplemental heating device heats at least one area or all of areas having a temperature lower than the temperature of an area having a highest temperature among the plurality of areas.

6 Claims, 3 Drawing Sheets

(56) References Cited

U.S. PATENT DOCUMENTS

| | | | | |
|---|---|---|---|---|
| 6,056,913 | A * | 5/2000 | Ebner | C21D 9/5737<br>266/104 |
| 2007/0215588 | A1 | 9/2007 | Machrowicz | |
| 2015/0208466 | A1 | 7/2015 | Ooyama et al. | |

* cited by examiner

ELECTRICAL HEATING DEVICE AND ELECTRICAL HEATING METHOD

INCORPORATION BY REFERENCE

This application is based upon and claims the benefit of priority from Japanese patent application No. 2015-143088, filed on Jul. 17, 2015, the disclosure of which is incorporated herein in its entirety by reference.

BACKGROUND OF THE INVENTION

1. Field of the Invention

The present invention relates to an electrical heating device and electrical heating method for electrically heating a material to be heated.

2. Description of Related Art

An electrical heating device that electrically heats a material to be heated by bringing a pair of electrodes into contact with the material to be heated with a predetermined distance between the electrodes and supplying an electric current flowing between the electrodes has been known (see, for example, Japanese Unexamined Patent Application Publication No. 2014-031566). This electrical heating device reduces a temperature irregularity during its electrical heating process by adjusting an electrical heating time for each area of the material to be heated according to the cross-sectional area (i.e., the cross-sectional dimension) of the material to be heated.

The present inventors have found the following problem. In the above-described electrical heating device, it is possible to reduce the temperature irregularity to some extent by adjusting the electrical heating time for areas of the material to be heated that can be predicted beforehand to have a low temperature such as areas having a large cross-sectional area and areas located at the ends of the material to be heated in the width direction. However, it is impossible to adjust the electrical heating time for areas that cannot be predicted beforehand to have a low temperature or areas that have a low temperature contrary to the advance prediction, thus causing a possibility of a temperature irregularity in the material to be heated. It should be noted that even in the case where a material to be heated is supplementarily heated by using supplemental heating means separately from the main electrical heating, if the supplemental heating is performed without knowing which areas will have a low temperature, there is a possibility that a part or the whole of the material to be heated could be excessively heated by this supplemental heating.

SUMMARY OF THE INVENTION

The present invention has been made to solve the above-described problem and a main object is to provide an electrical heating device and an electrical heating method capable of rectifying a temperature irregularity in a material to be heated by appropriately heating even an area of the material to be heated that cannot be predicted beforehand to have a low temperature or an area of the material to be heated that has a low temperature contrary to an advance prediction.

To achieve the above-described object, a first exemplary aspect of the present invention is an electrical heating device that electrically heats a material to be heated by bringing a plurality of electrodes into contact with the material to be heated with a predetermined distance between the electrodes and supplying an electric current flowing between the electrodes, including: temperature detection means for detecting temperature information of a plurality of areas of the material to be heated; supplemental heating means for heating each of the plurality of areas of the material to be heated; and control means for controlling heating of the material to be heated, in which during the electrical heating, the control means controls, based on the temperature of each of the plurality of areas of the material to be heated detected by the temperature detection means, the supplemental heating means so that the supplemental heating means heats at least one area or all of areas having a temperature lower than the temperature of an area having a highest temperature among the plurality of areas.

In this aspect, the control means may stop the electrical heating when the temperature of the area having the highest temperature reaches a predefined target temperature of the material to be heated based on the temperature of each of the plurality of areas detected by the temperature detection means.

In this aspect, the control means may control, based on the temperature of each of the plurality of areas detected by the temperature detection means, the supplemental heating means so that the supplemental heating means heats an area for which a difference between its temperature and the temperature of the area having the highest temperature is equal to or greater than a first threshold.

In this aspect, the control means may control, based on the temperature of each of the plurality of areas detected by the temperature detection means, the supplemental heating means so that the supplemental heating means heats an area for which a difference between its temperature and the temperature of the area having the highest temperature is equal to or greater than a first threshold and stops the heating when the difference becomes smaller than a second threshold smaller than the first threshold.

To achieve the above-described object, another exemplary aspect of the present invention may be an electrical heating method for electrically heating a material to be heated by bringing a plurality of electrodes into contact with the material to be heated with a predetermined distance between the electrodes and supplying an electric current flowing between the electrodes, including: detecting temperature information of a plurality of areas of the material to be heated; and supplementarily heating, during the electrical heating, based on the detected temperature of each of the plurality of areas of the material to be heated, at least one area or all of areas having a temperature lower than the temperature of an area having a highest temperature among the plurality of areas.

According to the present invention, it is possible to provide an electrical heating device and an electrical heating method capable of rectifying a temperature irregularity in a material to be heated by appropriately heating even an area of the material to be heated that cannot be predicted beforehand to have a low temperature or an area of the material to be heated that has a low temperature contrary to an advance prediction.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

First Exemplary Embodiment

Exemplary embodiments according to the present invention are explained hereinafter with reference to the drawings. For example, an electrical heating device according to a first exemplary embodiment of the present invention heat-treats a material to be heated such as a plate-like metal material (such as a structure for an automobile) by supplying electricity to the material to be heated and thereby directly heating the material to be heated.

Figure 1:
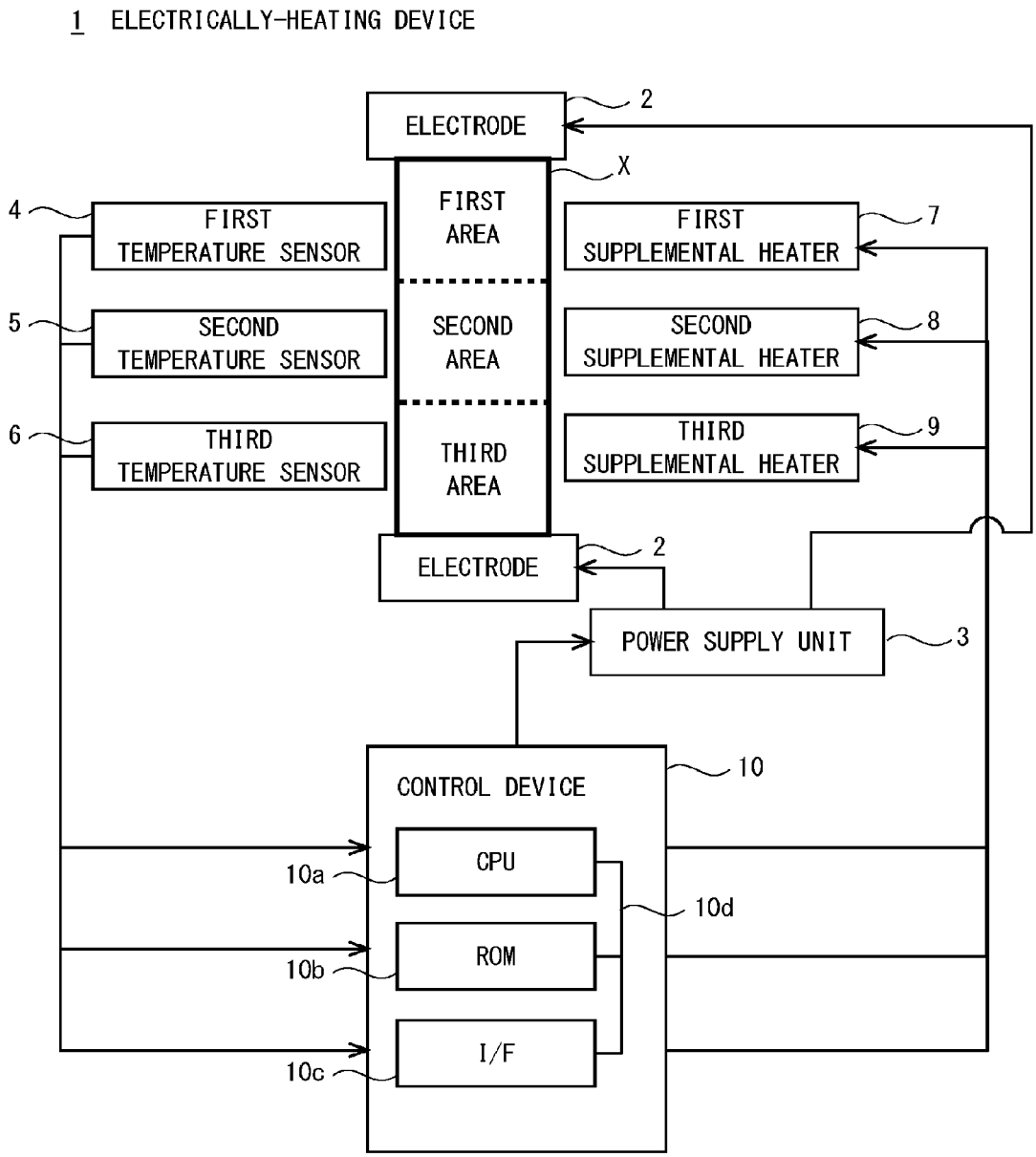
FIG. 1 is a block diagram showing a schematic system configuration of an electrical heating device according to an exemplary embodiment of the present invention.

FIG. 1 is a block diagram showing a schematic system configuration of an electrical heating device according to the first exemplary embodiment. The electrical heating device 1 according to the first exemplary embodiment includes a pair of positive and negative electrodes 2, a power supply unit 3 that supplies power to the positive and negative electrodes 2, first to third temperature sensors 4, 5 and 6 that detect temperature information of a plurality of areas of a material to be heated X, first to third supplemental heaters 7, 8 and 9 each of which heats a respective one of the plurality of areas of the material to be heated X, and a control device 10 that controls the power supply unit 3 and the first to third supplemental heaters 7, 8 and 9.

The positive and negative electrodes 2 are brought into contact with the plate-like material to be heated X with a predetermined distance between the positive and negative electrodes 2. Note that although a pair of positive and negative electrodes 2 are provided in the first exemplary embodiment, the present invention is not limited to such a configuration. For example, two pairs or more than two pairs of positive and negative electrodes 2 may be disposed. Further, the shape of the material to be heated X is not limited to the plate-like shape. For example, the material to be heated X may have a columnar shape or a rectangular-columnar shape.

The power supply unit 3 electrically heats the material to be heated X by supplying an electric current flowing between the positive and negative electrodes 2. For example, the power supply unit 3 is formed by a power supply such as a battery. The first to third temperature sensors 4, 5 and 6 are a specific example of the temperature detection means. The first to third temperature sensors 4, 5 and 6 detect the temperatures of respective predetermined areas of the material to be heated X. Note that the predetermined area means, for example, an area having a predetermined range or smaller within which the temperature does not vary from the temperature of a point on the material to be heated X that is detected by one of the first to third temperature sensors 4, 5 and 6 (or within which the temperature variations are equal to or less than a threshold). Each of the first to third temperature sensors 4, 5 and 6 is, for example, a radiation thermometer.

For example, the first to third temperature sensors 4, 5 and 6 are arranged along the longitudinal direction of the material to be heated X. The first temperature sensor 4 is disposed roughly on the left side of the material to be heated X (upper side in FIG. 1) and detects the temperature of a first area of the material to be heated X. The second temperature sensor 5 is disposed roughly at the center of the material to be heated X and detects the temperature of a second area of the material to be heated X. The third temperature sensor 6 is disposed roughly on the right side of the material to be heated X and detects the temperature of a third area of the material to be heated X. The first to third temperature sensors 4, 5 and 6 output the detected temperatures of the respective areas to the control device 10.

Note that one, two, four, or more than four temperature sensors may be disposed. That is, the number of temperature sensors may be arbitrarily determined. By increasing the number of temperature sensors, low-temperature areas of the material to be heated X can be detected in a more detailed manner. Further, the arrangement of temperature sensors may be arbitrarily determined, provided that the temperature of each area of the material to be heated X can be appropriately detected.

The first to third supplemental heaters 7, 8 and 9 are a specific example of the supplemental heating means. The first to third supplemental heaters 7, 8 and 9 heat respective predetermined areas of the material to be heated X. Each of the first to third supplemental heaters 7, 8 and 9 is, for example, a near-infrared heater or a far-infrared heater.

For example, the first to third supplemental heaters 7, 8 and 9 are arranged along the longitudinal direction of the material to be heated. The first to third supplemental heaters 7, 8 and 9 are disposed in places corresponding to the first to third temperature sensors 4, 5 and 6, respectively. That is, the first to third supplemental heaters 7, 8 and 9 heat the respective areas whose temperatures are detected by the first to third temperature sensors 4, 5 and 6, respectively. The first supplemental heater 7 is disposed roughly on the left side of the material to be heated X and heats the first area of the material to be heated X. The second supplemental heater 8 is disposed roughly at the center of the material to be heated X and heats the second area of the material to be heated X. The third supplemental heater 9 is disposed roughly on the right of the material to be heated X and heats the third area of the material to be heated X. The first to third supplemental heaters 7, 8 and 9 heat the respective areas of the material to be heated X according to a control signal from the control device 10.

Note that one, two, four, or more than four supplemental heaters may be disposed. That is, the number of supplemental heaters may be arbitrarily determined. By increasing the number of supplemental heaters, low-temperature areas of the material to be heated X can be heated in a more detailed manner, thus making it possible to reduce the temperature irregularity with higher accuracy. Further, the arrangement of supplemental heaters may be arbitrarily determined, provided that the temperature of each area of the material to be heated X can be appropriately detected. Alternatively, a configuration in which one or a plurality of supplemental heaters are moved to a low-temperature area(s) of the material to be heated X by using a moving mechanism such as a rail mechanism may be adopted.

The control device 10 is a specific example of the control means. The control device 10 controls the power supply unit 3 and the first to third supplemental heaters 7, 8 and 9 based on the temperatures output from the first to third temperature sensors 4, 5 and 6. The control device 10 electrically heats the material to be heated X by controlling the power supply unit 3 and thereby controlling the electric current flowing between the positive and negative electrodes 2. The control device 10 supplementarily heats each area of the material to be heated X by controlling the first to third supplemental heaters 7, 8 and 9.

For example, the control apparatus 10 may be formed by hardware mainly using a microcomputer including a CPU (Central Processing Unit) 10*a* that performs control processing, arithmetic processing, and so on, a memory 10*b* including a ROM (Read Only Memory) and/or a RAM (Random Access Memory) that stores a control program, an arithmetic program, and so on to be executed by the CPU 10*a*, and an interface unit (I/F) 10*c* that externally receives and outputs signals. The CPU 10*a*, the memory 10*b*, and the interface unit 10*c* are connected with each other through a data bus 10*d* or the like.

Incidentally, in the related-art electrical heating device, it is possible to reduce the temperature irregularity to some extent by adjusting the electrical heating time and the like for areas that can be predicted beforehand to have a low temperature such as areas having a large cross-sectional area and areas located at the ends of the material to be heated in the width direction. However, it is impossible to adjust the electrical heating time for areas that cannot be predicted beforehand to have a low temperature or areas that have a low temperature contrary to the advance prediction, thus causing a possibility of a temperature irregularity in the material to be heated. It should be noted that even in the case where a material to be heated is supplementarily heated by using a supplemental heater separately from the main electrical heating, if the supplemental heating is performed without knowing which areas will have a low temperature, there is a possibility that a part or the whole of the material to be heated could be excessively heated by this supplemental heating.

In contrast to this, in the first exemplary embodiment, during the electrical heating, the control device 10 controls, based on the temperatures of the first to third areas of the material to be heated X detected by the first to third temperature sensors 4, 5 and 6, the first to third supplemental heaters 7, 8 and 9 so that they heat at least one area or all of areas having a temperature lower than the temperature of the area having the highest temperature among the first to third areas. As a result, even when there is an area of the material to be heated that cannot be predicted beforehand to have a low temperature or an area of the material to be heated that has a low temperature contrary to an advance prediction, the electrical heating device can detect such a low-temperature area by using the first to third temperature sensors 4, 5 and 6. Then, the electrical heating device can rectify the temperature irregularity in the material to be heated by appropriately performing supplemental heating for the detected low-temperature area by using the first to third supplemental heaters 7, 8 and 9.

For example, the control device 10 controls the first to third supplemental heaters 7, 8 and 9 based on the temperatures detected by the first to third temperature sensors 4, 5 and 6 so that an area(s) of the material to be heated X having a low temperature (hereinafter called a "low-temperature area(s)") for which a difference between its temperature and the temperature Tmax of the area of the material to be heated X having the highest temperature (hereinafter called a "highest-temperature area") is equal to or greater than a first threshold is heated. Note that the aforementioned first threshold is, for example, set in the memory 10*b* in advance according to the processing accuracy for the material to be heated X. More specifically, the higher the processing accuracy for the material to be heated X is, the smaller the first threshold should be made. In this way, the temperature irregularity in the material to be heated X can be rectified more accurately.

For example, the control device 10 controls the heating for the low-temperature area of the material to be heated X by controlling the time (i.e., the duration) of heating by the first to third supplemental heaters 7, 8 and 9 while maintaining their heating output at a constant level. However, the present invention is not limited to such a method. That is, the control device 10 may control the heating for the low-temperature area of the material to be heated X by controlling the heating output of the first to third supplemental heaters 7, 8 and 9 while setting their heating time to a constant time. Alternatively, the control device 10 may control the heating for the low-temperature area of the material to be heated X by controlling both the heating time and the heating output of the first to third supplemental heaters 7, 8 and 9 at the same time.

Figure 2:
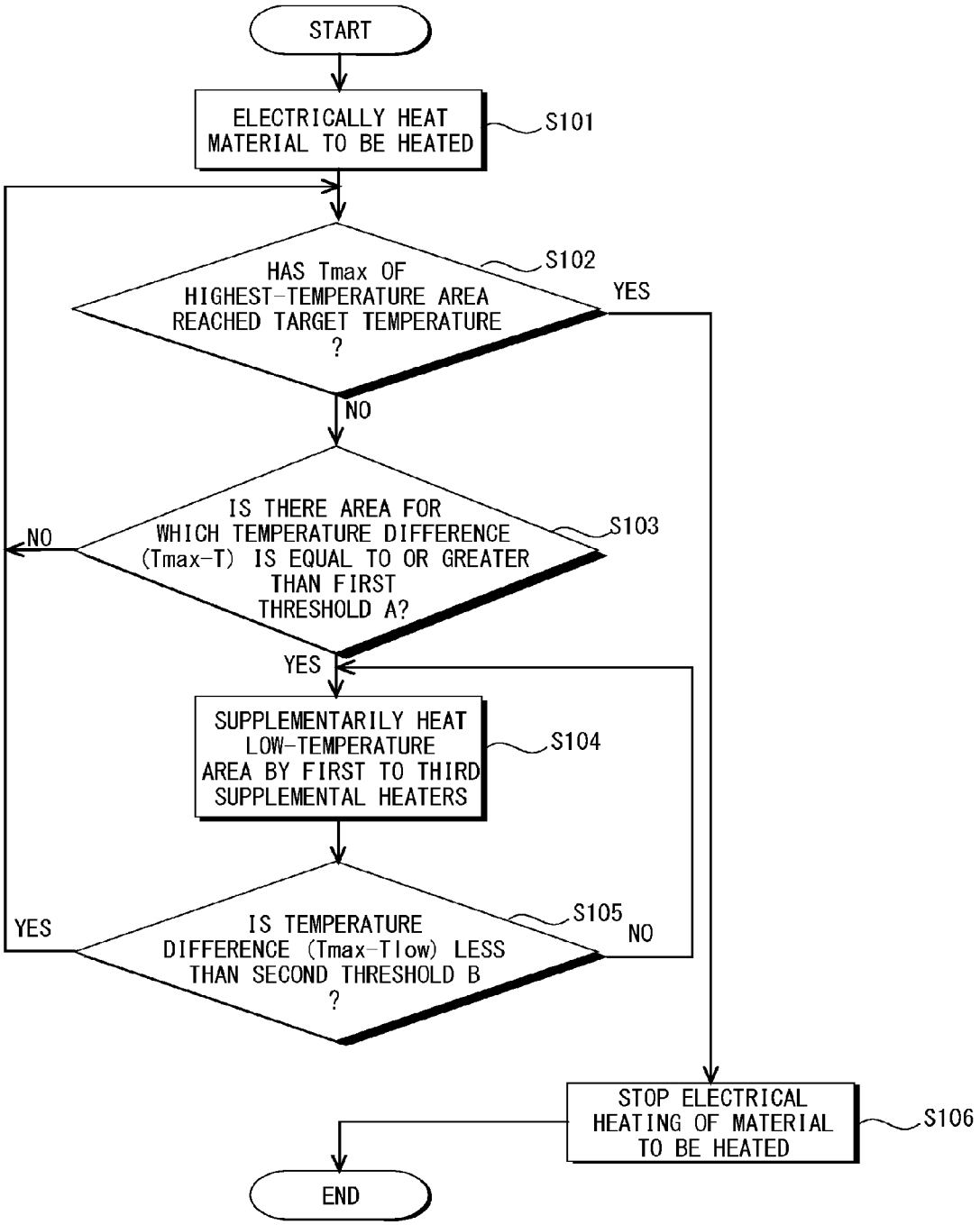
FIG. 2 is a flowchart showing an example of a process flow of an electrical heating method according to an exemplary embodiment of the present invention.

Next, an electrical heating method according to the first exemplary embodiment is explained. FIG. 2 is a flowchart showing an example of a process flow of an electrical heating method according to the first exemplary embodiment. The control device 10 electrically heats the material to be heated X by controlling the power supply unit 3 and thereby supplying an electric current flowing between the positive and negative electrodes 2 (step S101).

The control device 10 determines whether the temperature Tmax of the highest-temperature area of the material to be heated X has reached a target temperature or not based on the temperature T detected by the first to third temperature sensors 4, 5 and 6 (step S102). Note that the target temperature is, for example, set in the memory 10*b* in advance, with the characteristic of the material to be heated X being taken into consideration.

When the control device 10 determines that the temperature Tmax of the highest-temperature area of the material to be heated X has not reached the target temperature yet (No at step S102), the control device 10 determines whether or not there is a low-temperature area for which a difference (Tmax−T) between its temperature T and the temperature Tmax of the highest-temperature area of the material to be heated X is equal to or greater than a first threshold A (for example, A=8° C.) (step S103).

When the control device 10 determines that there is a low-temperature area for which the difference (Tmax−T) between its temperature T and the temperature Tmax of the highest-temperature area of the material to be heated X is equal to or greater than the first threshold A (Yes at step S103), the control device 10 supplementarily heats the determined low-temperature area by controlling one of the first to third supplemental heaters 7, 8 and 9 corresponding to that low-temperature area (step S104). On the other hand, when the control device 10 determines that there is no low-temperature area for which the difference (Tmax−T) between its temperature T and the temperature Tmax of the highest-temperature area of the material to be heated X is equal to or greater than the first threshold A (No at step S103), the control device 10 returns to the process of the above-described step S102.

The control device 10 determines whether or not the difference (Tmax−Tlow) between the temperature Tmax of the highest-temperature area of the material to be heated X and the temperature Tlow of the low-temperature area has decreased to or below a second threshold B smaller than the first threshold A (for example, B=6° C.) (step S105). Note that the aforementioned second threshold is, for example, set in the memory 10*b* in advance according to the processing accuracy for the material to be heated X. More specifically, the higher the processing accuracy for the material to be heated X is, the larger the second threshold B should be made. In this way, the temperature irregularity in the material to be heated X can be rectified more accurately.

When the control device 10 determines that the difference (Tmax−Tlow) between the temperature Tmax of the highest-temperature area of the material to be heated X and the temperature Tlow of the low-temperature area has not decreased to or below the second threshold B yet (No at step S105), the control device 10 returns to the process of the above-described step S104. As a result, the first to third supplemental heaters 7, 8 and 9 continue the heating of the low-temperature area. On the other hand, when the control device 10 determines that the difference (Tmax−Tlow) between the temperature Tmax of the highest-temperature area of the material to be heated X and the temperature Tlow of the low-temperature area has decreased to or below the second threshold B (Yes at step S105), the control device 10 returns to the process of the above-described step S102.

Note that the control device 10 may perform the heating of the low-temperature area by controlling the heating time of the first to third supplemental heaters 7, 8 and 9 according to the temperature difference (Tmax−T) from the temperature Tmax of the highest-temperature area without performing the threshold determination of the above-described step S105. For example, the control device 10 sets the heating time of the first to third supplemental heaters 7, 8 and 9 in such a manner that the larger the temperature difference (Tmax−T) from the temperature Tmax of the highest-temperature area is, the longer the heating time is made.

Figure 3:
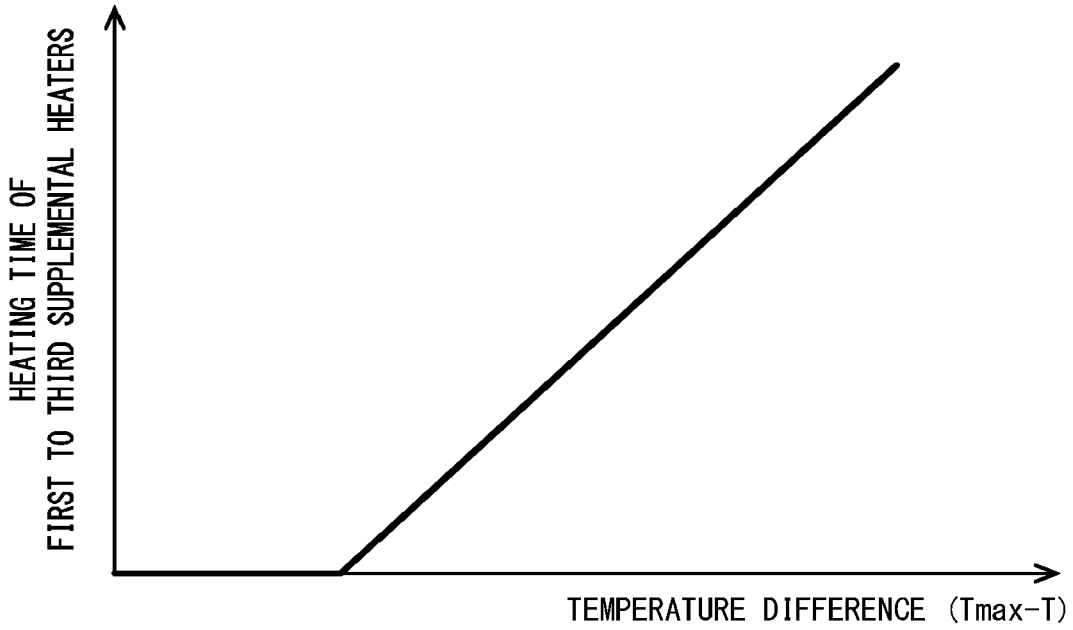
FIG. 3 shows an example of information of a relation between temperature differences (Tmax−T) and heating time of first to third supplemental heaters.

As shown in FIG. 3, information about a relation between the temperature difference (Tmax−T) from the temperature Tmax of the highest-temperature area and the heating time of the first to third supplemental heaters 7, 8 and 9 is set in advance in the memory 10*b*. The control device 10 may set the heating time of the first to third supplemental heaters 7, 8 and 9 based on the aforementioned relation information stored in the memory 10*b* and the temperature difference (Tmax−T) from the temperature Tmax of the highest-temperature area, and heat the low-temperature area for the set heating time. In this way, the determination using the second threshold B becomes unnecessary and hence the control process of the control device 10 is simplified (performed in a shorter time). Note that as described above, by performing the determination process using the second threshold B, the supplemental heating by the first to third supplemental heaters 7, 8 and 9 can be controlled with higher accuracy and hence the temperature irregularity in the material to be heated X can be rectified more accurately.

When the control device 10 determines that the temperature Tmax of the highest-temperature area of the material to be heated X has reached the target temperature (Yes at step S102), the control device 10 controls the power supply unit 3 and thereby stops the electrical heating of the material to be heated X (step S106). After that, the supplemental heating by the first to third supplemental heaters 7, 8 and 9 continues just for a period corresponding to the set heating time and then the above-described process is finished.

As described above, by prohibiting the electrical heating at the point when the temperature of the highest-temperature area of the material to be heated X has reached the target temperature, a limit is forcibly imposed on the temperature of the highest-temperature area. Therefore, it is possible to reliably prevent any of the areas of the material to be heated X from being excessively heated. Further, the supplemental heating by the first to third supplemental heaters 7, 8 and 9 is performed while performing the electrical heating in such a manner that the temperature of the highest-temperature area of the material to be heated X is limited to or below the target temperature. As a result, it is also possible to reliably prevent any excessive heating by the first to third supplemental heaters 7, 8 and 9 in addition to the excessive heating by the electrical heating. Therefore, excessive heating can be prevented over a larger area of the material to be heated X.

For example, in the case of electrical heating by the related-art electrical heating device, the in-surface temperature difference was 120° C. in a material to be heated made of metal having a width of 300 mm and a board-thickness of 1.2 mm. In contrast to this, for the same material to be heated, the in-surface temperature difference was reduced to 60° C. by performing electrical heating and supplemental heating by using the electrical heating device 1 according to the above-described exemplary embodiment. As a result, it was possible to significantly rectify the temperature irregularity in the material to be heated and the yield was improved by 16%.

As described above, in the electrical heating device 1 according to the first exemplary embodiment, during the electrical heating, the control device 10 controls, based on the temperatures of the first to third areas of the material to be heated X detected by the first to third temperature sensors 4, 5 and 6, the first to third supplemental heaters 7, 8 and 9 so that they heat at least one area or all of areas having a temperature lower than the temperature of the highest-temperature area. As a result, even when there is an area of the material to be heated that cannot be predicted beforehand to have a low temperature or an area of the material to be heated that has a low temperature contrary to an advance prediction, the electrical heating device can detect such a low-temperature area by using the first to third temperature sensors 4, 5 and 6. Then, the electrical heating device can rectify the temperature irregularity by appropriately performing heating for the detected low-temperature area by using the first to third supplemental heaters 7, 8 and 9.

Second Exemplary Embodiment

In a second exemplary embodiment according to the present invention, the control device 10 may specify, during the electrical heating, an area that becomes the highest-temperature area among the first to third areas and control the first to third supplemental heaters 7, 8 and 9 so that they supplementarily heat areas other than the highest-temperature area. Note that the configuration of the electrical heating device 1 according to the second exemplary embodiment is identical to that of the electrical heating device 1 according to the above-described first exemplary embodiment. Therefore, the same symbols are assigned to the same components and detailed explanations of them are omitted.

After a predetermined time has elapsed since the start of electrical heating, the control device 10 specifies an area that becomes the highest-temperature area among the first to third areas of the material to be heated X based on the temperatures of the first to third areas detected by the first to third temperature sensors 4, 5 and 6. Note that the aforementioned predetermined time is determined with consideration given to the material characteristic of the material to be heated X, the electric heating power, and so on so that a change in temperature can be observed in the material to be heated X when the determined predetermined has elapsed. Further, the control device 10 controls the first to third supplemental heaters 7, 8 and 9 so that they supplementarily heat the areas other than the specified highest-temperature area.

For example, when the control device 10 specifies the first area as the highest-temperature area based on the temperatures of the first to third areas of the material to be heated X detected by the first to third temperature sensors 4, 5 and 6, the control device 10 controls the second and third supplemental heaters 8 and 9 so that they supplementarily heat the second and third areas, which are the areas other than the first area.

When the temperature of one of the first to third areas of the material to be heated X has reached the target temperature based on the temperatures of the first to third areas detected by the first to third temperature sensors 4, 5 and 6, the control device 10 controls the power supply unit 3 and thereby stops the electrical heating.

As described above, according to the second exemplary embodiment, the temperature irregularity in the material to be heated X can be rectified by detecting a low-temperature area having a temperature lower than that of the highest-temperature area by using the first to third temperature sensors 4, 5 and 6 and appropriately heating the detected low-temperature area by using the first to third supplemental heaters 7, 8 and 9. Further, since the second exemplary embodiment does not perform the determination using the threshold for the supplemental heating unlike the above-described first exemplary embodiment, the process is simplified. As a result, the heating time of the material to be heated X can be reduced.

Note that the control device 10 may specify, during the electrical heating, an area that becomes the lowest-temperature area having the lowest temperature among the first to third areas and control the first to third supplemental heaters 7, 8 and 9 so that they supplementarily heat only the specified lowest-temperature area. This control method is effective when the temperature differences among the areas are likely to become larger because of the shape of the material to be heated X (such as when changes in shape are large) and/or the quality of the material of the material to be heated X (such as when the material to be heated is made of a plurality of types of materials). The temperature irregularity in the material to be heated can be rectified in a pinpoint accuracy by specifying only the lowest-temperature area by using the first to third temperature sensors 4, 5 and 6 and intensively performing the supplemental heating only for the specified lowest-temperature area.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electrical heating device that electrically heats a material to be heated by bringing a plurality of electrodes which are connected with a power supply unit into contact with the material to be heated with a predetermined distance between the electrodes and supplying an electric current flowing between the electrodes, comprising:

temperature detection means for detecting temperature information of a plurality of predetermined areas of the material to be heated;

supplemental heating means for heating each of the plurality of predetermined areas of the material to be heated; and control means for controlling heating of the material to be heated, wherein during the electrical heating, the control means controls, by mutually comparing the temperature of each of the plurality of predetermined areas of the material to be heated detected by the temperature detection means, the supplemental heating means so that the supplemental heating means heats at least one predetermined area or all of predetermined areas having a temperature lower than the temperature of a predetermined area having a highest temperature among the plurality of predetermined areas.

2. The electrical heating device according to claim 1, wherein the control means stops the electrical heating when the temperature of the predetermined area having the highest temperature reaches a predefined target temperature of the material to be heated based on the temperature of each of the plurality of predetermined areas detected by the temperature detection means.

3. The electrical heating device according to claim 1, wherein the control means controls, based on the temperature of each of the plurality of predetermined areas detected by the temperature detection means, the supplemental heating means so that the supplemental heating means heats a predetermined area for which a difference between its temperature and the temperature of the predetermined area having the highest temperature is equal to or greater than a first threshold.

4. The electrical heating device according to claim 3, wherein the control means controls, based on the temperature of each of the plurality of predetermined areas detected by the temperature detection means, the supplemental heating means so that the supplemental heating means heats a predetermined area for which a difference between its temperature and the temperature of the predetermined area having the highest temperature is equal to or greater than a first threshold and stops the heating when the difference becomes smaller than a second threshold smaller than the first threshold.

5. An electrical heating method for electrically heating a material to be heated by bringing a plurality of electrodes which are connected with a power supply unit into contact with the material to be heated with a predetermined distance between the electrodes and supplying an electric current flowing between the electrodes, comprising:

detecting temperature information of a plurality of predetermined areas of the material to be heated; and supplementarily heating, during the electrical heating, by mutually comparing the detected temperature of each of the plurality of predetermined areas of the material to be heated, at least one predetermined area or all of predetermined areas having a temperature lower than the temperature of a predetermined area having a highest temperature among the plurality of predetermined areas.

6. An electrical heating device that electrically heats a material to be heated by bringing a plurality of electrodes which are connected with a power supply unit into contact with the material to be heated with a predetermined distance between the electrodes and supplying an electric current flowing between the electrodes, comprising:

a temperature detection unit that detects temperature information of a plurality of predetermined areas of the material to be heated;

a supplemental heating unit that heats each of the plurality of predetermined areas of the material to be heated; and a control unit that controls heating of the material to be heated, wherein during the electrical heating, the control unit controls, by mutually comparing the temperature of each of the plurality of predetermined areas of the material to be heated detected by the temperature detection unit, the supplemental heating unit so that the supplemental heating unit heats at least one predetermined area or all of predetermined areas having a temperature lower than the temperature of a predetermined area having a highest temperature among the plurality of predetermined areas.

* * * * *